United States Patent [19]

Buckenham et al.

[11] 4,423,487

[45] Dec. 27, 1983

[54] APPARATUS FOR MEASURING THE EFFICIENCY OF COMBUSTION APPLIANCES

[75] Inventors: Howard A. Buckenham, Brentwood; Hugh V. Feldman; Paul Gotley, both of Harlow; Richard Young, High Wycombe, all of England

[73] Assignee: Neotronics Limited, Takeley, England

[21] Appl. No.: 208,693

[22] Filed: Nov. 20, 1980

[30] Foreign Application Priority Data

Nov. 23, 1979 [GB] United Kingdom ..... 7940671
Oct. 22, 1980 [GB] United Kingdom ..... 8034110

[51] Int. Cl.[3] ..... G06F 15/20; G01D 21/02; F23N 5/24

[52] U.S. Cl. ..... 364/551; 73/112; 236/15 BB; 364/571; 364/573

[58] Field of Search ..... 364/500, 504, 550, 551, 364/557, 573; 73/112; 236/15 E, 15 BB, 15 BD

[56] References Cited

U.S. PATENT DOCUMENTS

| | | | |
|---|---|---|---|
| 2,723,558 | 11/1955 | Germer | 73/112 |
| 2,723,559 | 11/1955 | Germer | 73/112 |
| 2,947,934 | 8/1960 | Bolie | 364/857 X |
| 3,662,163 | 5/1972 | Miller et al. | 364/573 X |
| 3,939,459 | 2/1976 | Hoopes | 364/573 X |
| 4,150,939 | 4/1979 | Hayes | 431/76 |
| 4,179,745 | 12/1979 | Wuertele | 364/573 X |
| 4,241,303 | 12/1980 | Thompson | 364/573 X |

FOREIGN PATENT DOCUMENTS

| | | | |
|---|---|---|---|
| 2753520 | 6/1979 | Fed. Rep. of Germany | 236/15 E |
| 457111 | 11/1936 | United Kingdom . | |
| 937248 | 9/1963 | United Kingdom . | |
| 973255 | 10/1964 | United Kingdom . | |
| 1218464 | 1/1971 | United Kingdom | 340/347 AD |
| 2016707 | 9/1979 | United Kingdom | 431/76 |
| 1561020 | 2/1980 | United Kingdom | 431/76 |
| 1562536 | 3/1980 | United Kingdom | 431/76 |

OTHER PUBLICATIONS

Sheingold: Analog-Digital Conversion Handbook by Analog Devices, Jun. 1972, pp. I-64, I-65 of interest.

Robertson: The Application of Microprocessors to Process Control, 5th BNF International Conference, London, Sep. 1977, Paper #11.

Crossley: Improving the Measurement of $O_2$ in Flue Gas, Power and Works Engineering, Oct. 1979.

*Primary Examiner*—Felix D. Gruber

*Attorney, Agent, or Firm*—Anthony H. Handal

[57] ABSTRACT

This disclosure relates to apparatus of the kind suitable for taking spot measurements of the heat loss or stack loss and/or efficiency ($\eta$) in flue gases (stack loss) and comprises respective sensors (5, 3) for producing output signals which vary with the temperature and the concentration of a constituent gas e.g. $O_2$ of the flue gases and microprocessor-based computation means (10) arranged to derive measurement values of (and numerically equal to) the measured temperature and constituent gas concentration, from the two sensors and to apply these measurement values in the computation of a predetermined formula relating the stack loss or efficiency to the measured quantities. In accordance with the invention, the apparatus is arranged to automatically calibrate each sensor signal from a test measurement prior to deriving the measurement values. This may be achieved in the case of a sensor having a non-linear response, by performing a calculation of a formula defining the non-linear response of the sensor using a coefficient derived from the test measurement. The sensor output signal is thus automatically calibrated and "linearized" from a single test measurement. The predetermined stack loss or efficiency formula may be modified for different types of fuel, and temperature and $O_2$ (or $CO_2$) values used in the calculation as well as the result of the calculation may be presented on a visual display (24).

23 Claims, 6 Drawing Figures

APPARATUS FOR MEASURING THE EFFICIENCY OF COMBUSTION APPLIANCES

This invention relates to apparatus for measuring the degree of efficiency of combustion appliances using fossil fuels.

A known method of determining the degree of efficiency of a combustion appliance, e.g. a boiler or a furnace, involves measurement of the oxygen or $CO_2$ concentration and the temperature of the exhaust gases, and the measured values are then referred to a standard chart showing either the "stack loss" (proportion of heat loss) or efficiency values for different temperature and oxygen or $CO_2$ concentration values. For different types of fuel, e.g. solid fuel, fuel oil or natural gas, a different chart must be referred to. Apart from accuracy limitations inherent in the use of such charts, a possibility exists of the operator referring to the wrong chart i.e. to the chart of the wrong fuel, or referring to the wrong line or column of the chart, or possibly even misinterpreting or misreading the readings on one or both of the measurement instruments.

Various forms of apparatus have been proposed in an attempt to overcome these disadvantages by providing means for automatically determining the degree of efficiency from temperature and $O_2$ or $CO_2$ concentration measurement of the exhaust gases.

For example, U.K. Patent Application No. 2016707 discloses apparatus for performing a predetermined algorithms relating the operating efficiency ($\eta$) to the output signals of temperature and oxygen concentration sensors of the exhaust gases and embodying corrections for the non-linearity of the $O_2$ and temperature sensors used. This, however, has the disadvantage that separate indications of the actual $O_2$ concentration and exhaust gas temperature cannot be separately indicated since the non-linearity corrections for the sensors are integrally embodied in the single algorithm.

Another form of apparatus is disclosed in U.K. Pat. No. 1,562,576 in which an electronic computing device receives output signals from an $O_2$ or $CO_2$ concentration sensor and a temperature sensor and computes the efficiency $\eta$ in accordance with a predetermined formula relating this quantity to the $O_2$ or $CO_2$ concentration and the temperature of the exhaust gases. However, such apparatus assumes a linearity in the variation of the received sensor signals with the measured quantities. This can rarely be achieved, particularly in the case of gas concentration sensors.

The problem of calibrating an $O_2$ concentration sensor is discussed in "Improving the measurement of $O_2$ in flue gases", an article by Alan M. Crossley in "Power & Works Engineering", October, 1979.

The proposed solution, however, involves taking a number of test measurements of test gases having different known concentrations of $O_2$ over the range of interest, and is accordingly cumbersome and time-consuming.

It is an aim of the present invention to provide apparatus for measuring the degree of efficiency of a combustion appliance which enables one or more of the above-mentioned disadvantages to be overcome or at least to be substantially reduced.

According to the present invention, apparatus for measuring the degree of efficiency of a combustion appliance comprises a first sensor for producing an output signal which varies with the concentration of a constituent gas of the exhaust gases of the appliance, a second sensor for producing an output signal which varies with the temperature of the exhaust gases, and computation means adapted to receive the sensor output signal, to derive therefrom measurement values representing the concentration of said constituent gas and the temperature of the exhaust gas and to apply these measurement values in the computation of a predetermined formula relating the degree of combustion efficiency to the temperature of, and the concentration of said constituent gas in the exhaust gases, the computation means being operable prior to deriving a measurement value therefrom, to calibrate at least one of the sensor signals from a test measurement made with that sensor.

In a preferred embodiment, this is achieved in the case of a sensor having a known non-linear relationship between its output signal and the quantity to be measured, by computing the value of a coefficient of an equation or formula defining that non-linear relationship from the sensor output signal produced by the test measurement. This coefficient, which may conveniently be referred to as a calibration coefficient, is then used by the computation means in deriving a measurement value of the exhaust gases in accordance with the equation defining the non-linear relationship between the sensor output signal and the quantity to be measured. In this way, the sensor signal is calibrated, and the non-linearity of the response of the sensor automatically compensated simultaneously from a single test measurement.

The degree of efficiency of the combustion appliance may be provided by determining the heat loss or stack loss of the exhaust gases, or of the operating efficiency ($\eta$) of the appliacne.

The particular predetermined formula used in computing these values from the derived measurement values of the constituent gas concentration and the temperature of the exhaust gases relies on a previous computation of the stack loss. In the preferred case of the constituent gas being oxygen, the stack loss is preferably computed in accordance with the following formula:

$$\text{Stack Loss} = \frac{K_3 (T_1 - T_2)}{\%\ O_{2IN} - \%\ O_{2OUT}}$$

where $K_3$ is a constant related to the type of fuel, $T_1$ and $T_2$ are the temperature of the flue or exhaust gases and a reference temperature, e.g. the ambient temperature respectively, and $\%O_{2IN}$ and $\%O_{2OUT}$ are the respective percentage oxygen concentrations of the air supplied to the heating appliance, which may be nominally set substantially equal to 21, and the exhaust gases.

Alternatively, the constituent gas, the concentration of which is measured, may be $CO_2$, in which case the stack loss may be calculated substantially as follows:

$$\text{Stack Loss} = \frac{K_1 (T_1 - T_2)}{\%\ CO_2}$$

where $T_1$ and $T_2$ are as previously, $K_1$ is again a constant related to the type of fuel used, and $\%CO_2$ is that of the exhaust gases.

Whichever stack loss formula is used, and whether based on the $\%O_2$ or $\%CO_2$ of the exhaust gases, the following preferred formula may be used in determining the operating efficiency ($\eta$) of the heating appliance:

$$\text{Efficiency} = 100 - [R + (\text{Stack loss}) + K_4\{P + (T_1 = T_2)\}]$$

where R and P are constants related to the type of heating appliance and the moisture and hydrogen content of the exhaust gases, $K_3$ and $K_4$ are constants related to the type of fuel used, and $T_1$ and $T_2$ are as previously defined.

Preferably, therefore, the temperature sensor may be adapted to produce an output signal related to the value of $(T_1 - T_2)$ for example, a thermocouple the cold or reference junction of which in use is placed in the ambient atmosphere, while the 'hot' junction is placed in the flue gases. Preferably, a Type K alloy thermocouple is used.

Preferably, different values for the constants $K_1$, $K_3$ and $K_4$ as appropriate for different types of fuels, such as solid fuel, fuel oil or natural gas, are stored in the computation means, and the apparatus includes means for selecting which value of the constant is to be used in the computation of the predetermined formula.

To simplify operation of the apparatus and to reduce the possibility of error, the computation means is preferably operable to automatically perform individual stages of the operating procedure from test measurements for calibration purposes, through derivation of the measurement values of the constituent gas concentration and temperature from measurements taken of the exhaust gases, to final computation of the stack loss and/or operating efficiency, upon receiving instructions from the operator, conveniently by means of switching or like devices. Accordingly, the apparatus may also include means for visually or audibly indicating when some or each of these individual stages has been successfully completed, so that the appropriate switching device can be actuated to enable the next operating stage to be performed.

An embodiment of the invention will now be described in greater detail, by way of example only, with reference to the accompanying drawings, in which.

Figure 1:
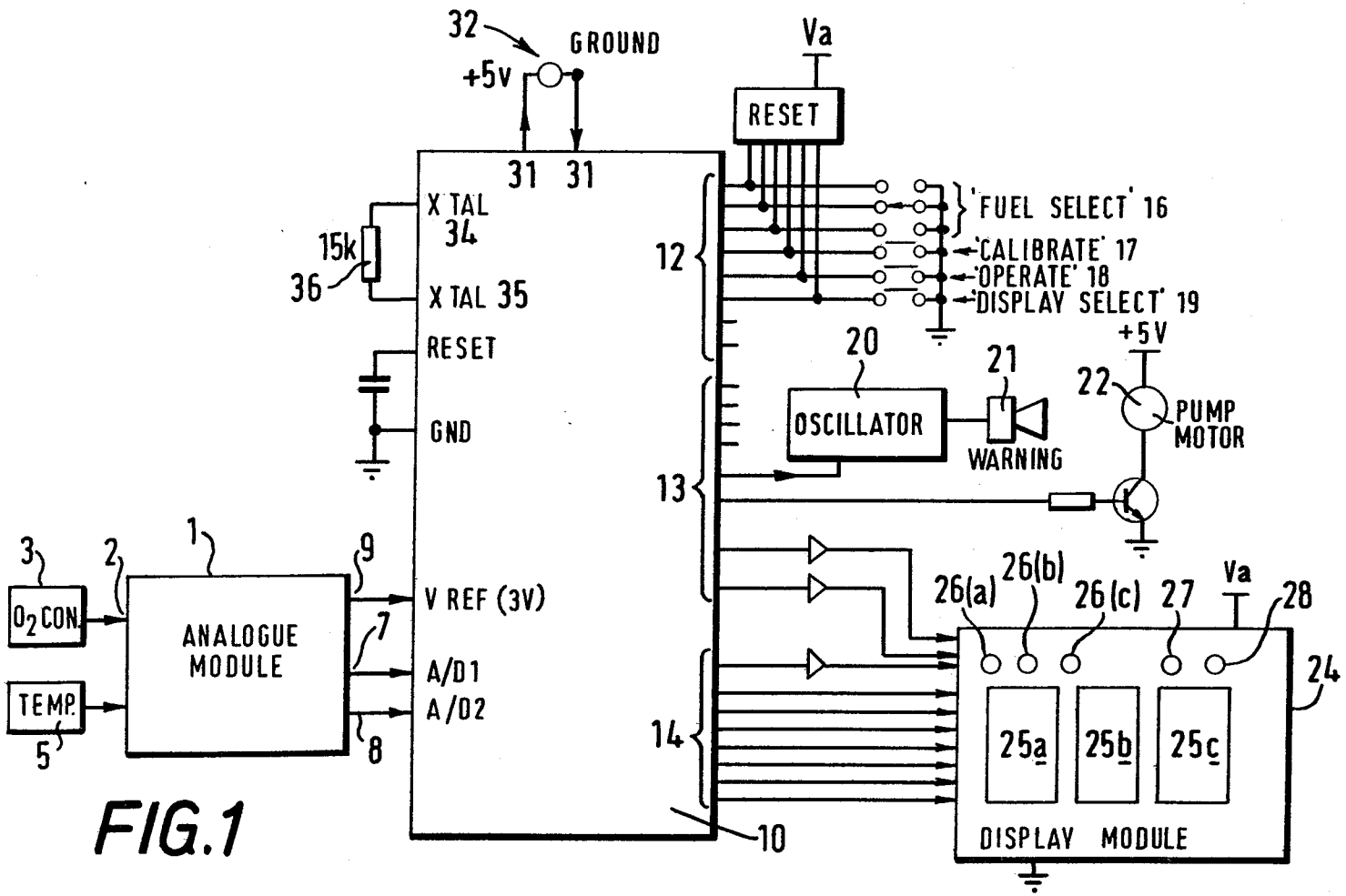
FIG. 1 shows a block schematic diagram of a fuel efficiency monitor in accordance with the invention.
Figure 5:
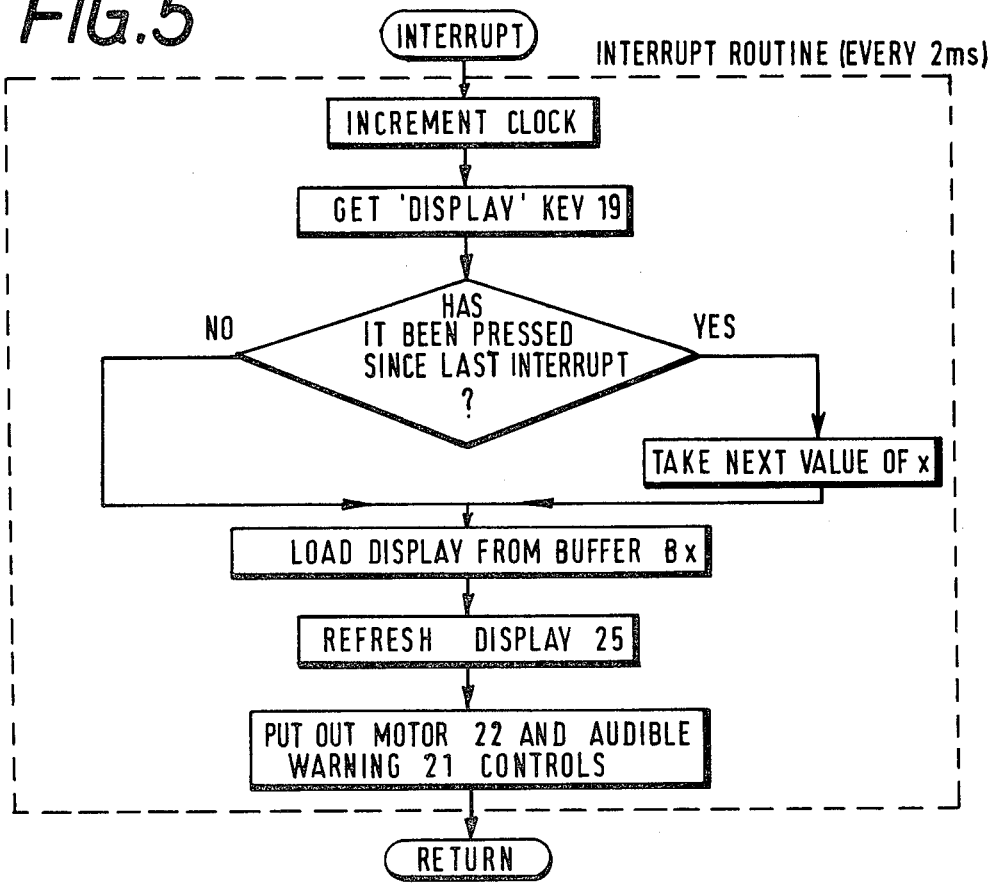
Figure 3A:
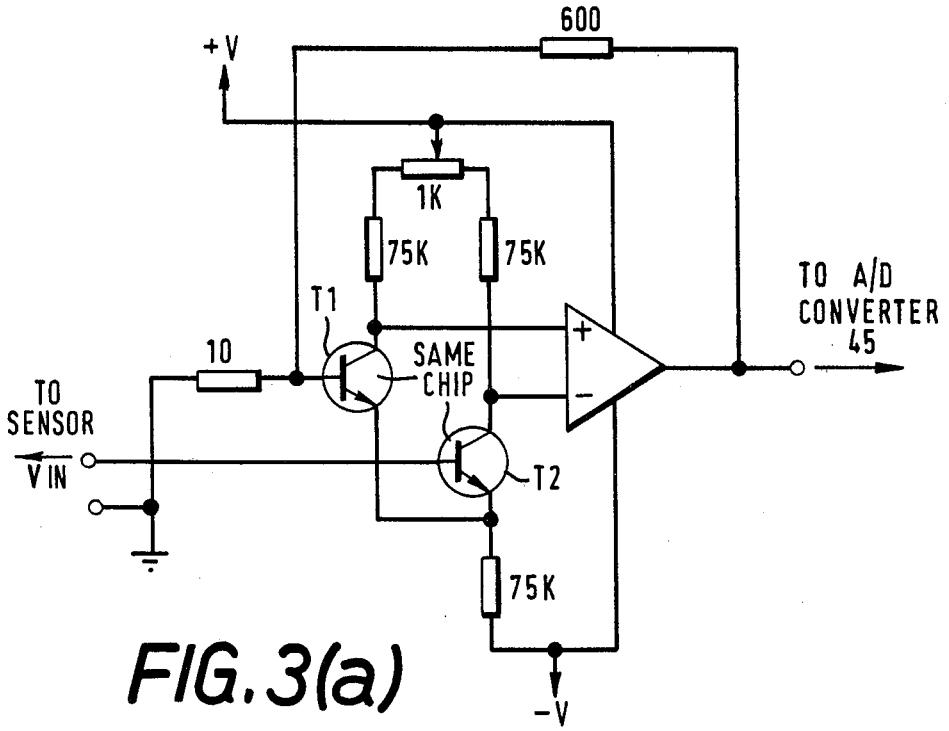
Figure 3B:
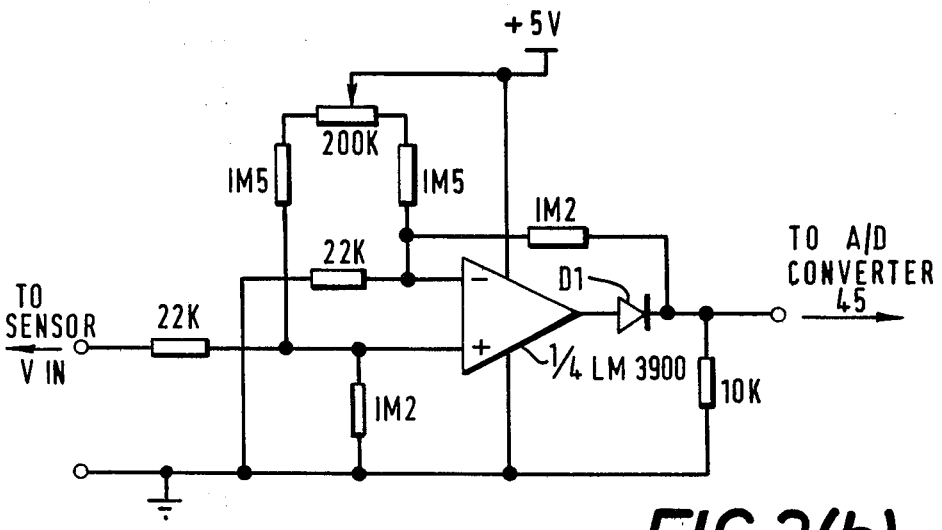
Figure 4:
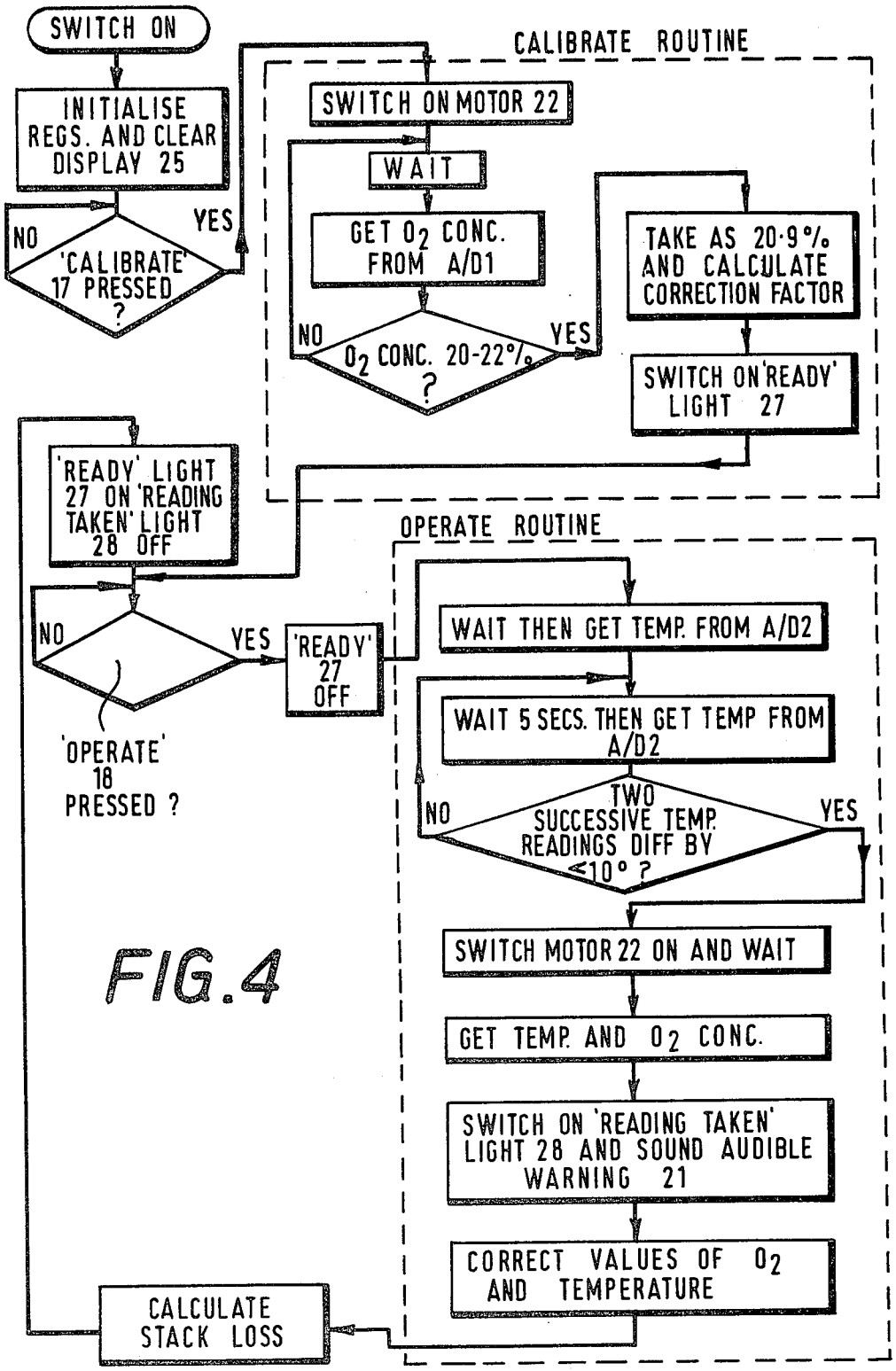

FIGS. 3(*a*) and 3(*b*) are circuit diagrams of two forms of amplifier suitable for use in the monitor shown in FIG. 1; and FIGS. 4 and 5 are flow charts of different parts of a programme which controls the operation of the apparatus shown in FIG. 1.

Referring to FIG. 1 the apparatus comprises an analogue module 1 having a first input terminal 2 for receiving the output from an oxygen sensor 3 and a second input terminal 4 for receiving the output from a temperature sensor 5. The analogue module 1 includes respective amplifiers for linearly amplifying the input voltages received at its two input terminals to produce full scale output voltages at respective output terminals 7, 8 each equal to the value of a reference voltage, typically 3 volts, independently produced within the analogue module 1 at a third output terminal 9.

The output terminals 7, 8, 9 of the analogue module 1 are connected to respective input terminals designated A/D 1, A/D 2 and VREF of an 8-bit microprocessor chip 10 incorporating an internal 8-bit A/D converter having two input channels. The terminals A/D 1, A/D 2 provide the input connections for the two A/D converter channels while the voltage applied to the input terminal VREF from the analogue module 1 determines the upper limit of the conversion range. The microprocessor chip 10 used in the present example is a commercially available component, sold under the designation INTEL (Registered Trade Mark) 8022 and manufactured by Intel Corporation of America, U.S.A. It is particularly suited to the present application as the required two-channel A/D conversion facility is built in obviating the need for external A/D conversion of the output signals of the oxygen and temperature sensors 3,5.

The microprocessor chip 10 also has three input/output (I/O) ports 12, 13, 14 of 8 lines each. Three of the I/O lines of the first port 12 are connected to a three-way fuel select switch 16, while another three lines are connected to respective switches 17, 18, 19, for selecting an appropriate one of three different operating programmes stored in a read-only-memory (ROM) having a capacity of 2K (8-bit) words contained in the microprocessor chip 10.

The second port 13 has one of its I/O lines connected to enable an oscillator 20 feeding a speaker 21 for sounding an audible warning tone when an oxygen concentration measurement has been taken, and another line connected to operate the motor 22 of an air suction pump for drawing air into the oxygen sensor 3 before an oxygen concentration measurement is to be taken. Another two of the I/O lines of the second port 13, together with the 8 I/O lines of the third port 14 are connected to respective inputs of a display module 24.

The display module 24 comprises three seven-segment alpha-numeric displays 25*a*, 25*b*, 25*c* driven by seven of the I/O lines of the third I/O port 14 of the microprocessor 10, a group of three indicator lights 26*a*, 26*b*, 26*c* controlled by the eighth I/O line of port 14 for indicating which of three quantities, temperature, % oxygen or efficiency, is being displayed on the alpha-numeric displays 25*a*, 25*b*, 25*c* and two further indicator lights 27, 28 controlled by the two I/O lines of port 13 connected to the display module 24, one 27 for indicating when the oxygen sensor signal has been successfully calibrated and the other 28 for indicating when an oxygen concentration reading has successfully been completed.

Other terminals on the microprocessor chip include power supply terminals 30, 31 across which a stabilised +5 V supply 32 is connected, a pair of crystal control terminals 34, 35 across which a timing element 36 is connected to control the timing of an internal crystal-controlled oscillator and clock circuit built into the microprocessor chip 10. In the present example, the timing element 36 consists of a 15k resistor which sets the clocking period of the processor at 5 μs giving an instruction cycle time of 150 μs (30 clocking periods).

Figure 2:
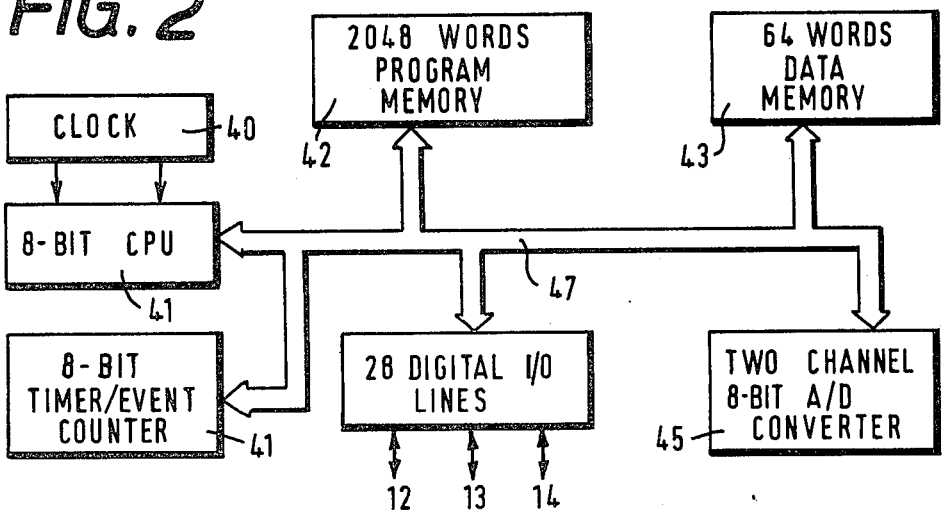
FIG. 2 shows the internal architecture of a microprocessor forming part of the monitor of FIG. 1.

FIG. 2 shows a block schematic diagram of the internal architecture of the microprocessor chip 10, comprising a clock 40, the clocking period of which is determined by the timing element 36 (FIG. 1), and which controls the instruction cycle time of the microprocessor via an 8-bit central processing unit (CPU) 41. The CPU 41 carries out various arithmetic operations and controls the operation of the remaining sections of the microprocessor in accordance with programme instructions stored in a read-only-memory (ROM) 42 mentioned earlier. The microprocessor also includes a data memory 43 having a capacity of 64, 8-bit words, which can be accessed during operation both to have data written into it and to have data read from it; an 8-bit timer/event counter 44; and a two-channel 8-bit A/D converter 45 which was discussed earlier in connection with the analogue module 1 (FIG. 1). The CPU 41, the programme memory 42 the data memory 43, the timer/event counter 44 and the two-channel A/D converter 45 are all interconnected with one another, and to the three I/O ports 12, 13, 14 by means of an internal bus network 47.

Referring again to FIG. 1, the gain of the respective amplifiers in the analogue module 1 required to bring the output signals of the oxygen sensor 3 and the temperature sensor 5 up to a full scale value of about 3 volts will depend upon the range of these two output signals. The required maximum range of oxygen concentrations to be measured by the oxygen sensor 3 in the present example is from 0 to about 22% (20.9% being the nominal ambient oxygen concentration of air).

A particularly suitable form of oxygen sensor is that commercially available under the designation "C/S" and manufactured by City Technology Limited, London, England, which when loaded by a 47 ohm resistor gives a full scale output voltage of 47 mV for the ambient air oxygen concentration (20.9%). This form of oxygen sensor operates on an electrolytic principle. The sensor is self-powered, diffusion limited and consists basically of a metal anode, electrolyte and an air cathode. The diffusion of oxgyen to the air cathode is controlled by a capillary diffusion barrier.

The amplifier in the analogue module 1 associated with the oxygen sensor may therefore have a gain of about 60 to produce a full scale output voltage of 3 volts for an input signal of 50 mV representing a maximum oxygen concentration of about 22%.

A preferred form of temperature sensor comprises a "Type K" alloy thermocouple as defined in British Standard B.S. No. 4937 part 4:1973, the output of which varies with temperature at a rate of about 4.1 mV per 100° C. giving a full scale reading of about 41 mV at 1000° C., the upper limit of the temperature range of interest. Again, an amplification factor of 60 would be suitable for the output signal of this thermocouple, giving a full scale output voltage of about 2.6 volts for a sensor output voltage of 45 mV.

To obtain an overall instrumental accuracy of within ±1% the amplifiers within the analogue module which may be of a commercially available form, maintain an accuracy of better than ±1% over a working temperature range of 20° C., and any temperature drift is compensated for automatically to eliminate the need for re-calibration while in use.

FIGS. 3*a* and 3*b* show purely by way of example two alternative suitable forms of D.C. operational amplifier circuitry for amplifying the outputs of the sensors 3, 5. The circuit of FIG. 3*a* uses a dual transistor pre-amplifier T1, T2 (preferably both from the same chip) while FIG. 3*b* uses an output diode D1, with the input being ground-referenced.

The linearly amplified sensor output signals from the analogue module 1 are then applied to respective channels of the 8-bit A/D converter 45 of the microprocessor 10 via the input terminals A/D 1, A/D 2. Both channels of the A/D converter 45 are set to produce a full scale digital reading of 256 when a maximum input voltage of 3 volts, is applied to. The value of this maximum voltage is set by the reference voltage applied to terminal V REF. Thus each increment of the digital range corresponds to about 12 mV. The result of the A/D conversion on either channel can be read from the A/D converter 45 via the internal bus network 47 during the course of a programme.

However, before these values can be used to provide an accurate measurement, the temperature and oxygen sensor signal from sensors 5, 3 must be calibrated as is well understood, the calibration of such sensor signals is necessary in order to correct for irregularities in the output voltage of the sensors which voltage may vary from sensor to sensor for a given measurement due for example to production variations, or from time to time with the same sensor due to variations in the conditions prevailing at the time of measurement. In addition, the output of the oxygen sensor needs to be linearised in relation to the measured parameter because its output voltage varies in a non-linear fashion with respect to the $O_2$ concentration measured. In the case of the $O_2$ sensor a correction is performed on the digital value of the sensor output signal.

The relationship between the output voltage of the oxygen sensor and the actual oxygen level sampled is exponential:

$$C = 1 - \exp\frac{-S}{k} \qquad \text{(I)}$$

where C is the fractional oxygen concentration (e.g. 0.209 in ambient air), S is the output signal from the sensor and k is a constant.

Expanding the exponential gives:

$$\exp\frac{-S}{k} = 1 - \frac{S}{k} + \frac{S^2}{2k^2} - \frac{S^3}{6k^3} \qquad \text{(II)}$$

and so C=S/k may be taken as a first approximation, and $$C = \frac{S}{k}\left(1 - \frac{S}{2k}\right) \qquad \text{(III)}$$

as a second approximation.

However, before the value of C, the oxygen concentration can be calculated from one or other of these approximations, the value of k, the calibration constant, must first be derived. This is done by taking an initial calibration reading of the oxygen concentration of a test gas, e.g. ambient air, and assigning to it the resulting A/D converted digital reading S'. The nominal fractional oxygen concentration of ambient air C'−0.209.k is then calculated in accordance with the following equation, derived from equation (I):

$$k = \frac{S'}{\log_e \frac{1}{1 - C'}} \qquad \text{(IV)}$$

$$= 4.2651 \times S' \text{ (for ambient air as the test gas)}$$

Having determined a value for k from the initial calibration reading S', this value is stored and used as the calibration constant in determining the actual oxygen concentration using equation (I), or rather one of the simplified approximations given by equation (II) or (III) (in this example equation (III)) from a subsequent measurement.

The "Type K" alloy thermocouple 5 produces an output voltage which is substantially linear over most of the range of interest i.e. 50° to 1000° C.

Calibration of the thermocouple signal is required, however, and this is conveniently achieved by appropriate adjustment of the offset voltage of the associated amplifier in the analogue module prior to taking a flue measurement, based on a reading of the ambient temperature at which the thermocouple output voltage must be zero since both junctions are at the same (ambient) temperature.

When taking a flue measurement, the thermocouple will automatically record the difference in temperature between the flue gases and ambient.

Alternatively, the microprocessor 10 may be arranged to store a value representative of the thermocouple output signal produced by the ambient temperature test measurement and to subtract this reference value from the appropriate value produced by the thermocouple on measurement of the exhaust gases.

The measurement junction of thermocouple 5 and the oxygen sensor 3 are both housed in hollow cavity on a common probe. A small motor-driven pump 22 is actuated by the microprocessor 10 to draw air into the cavity when an oxygen reading is to be taken.

It can be shown (British Standard BS. No. 845:1972) that the heat loss in dry flue gases based on the nett calorific value (stack loss) is given by:

$$\text{Stack Loss} = \left[\frac{K_1 (T_1 - T_2)}{\% \, CO_2}\right] \quad \text{(V)}$$

where $K_1$ is a constant dependent upon the type of fuel, $T_1$ is the flue gas temperature, $T_2$ is the ambient temperature. The $\%CO_2$ is given by the formula:

$$\% \, CO_2 = \left(1 - \frac{\% \, O_2}{21}\right) \times K_2 \quad \text{(VI)}$$

where $K_2$ *L is the maximum theoretical % CO2* value. Substituting equation (VI) into equation (V) and defining $$K_3 = \frac{21 K_1}{K_2}$$

gives:

$$\text{Stack loss} = \left[\frac{K_3 (T_1 - T_2)}{21 - \% \, O_2}\right] \quad \text{(VII)}$$

The difference between the flue temperature and ambient ($T_1 - T_2$) is given automatically by the thermocouple reading since its cold or reference junction is at ambient, and the $\%O_2$ value is given by the oxygen sensor reading. Inserting these values into equation (VII), is used to give the stack loss measurement, using the following values of $K_1$, $K_2$ and $K_3$ for solid fuel, for fuel oil and natural gas:

| | $K_1$ | $K_2$ | $K_3$ | $K_3$ (rounded) |
|---|---|---|---|---|
| Solid Fuel | 0.65 | 18.5% | 0.73784 | 0.738 |
| Fuel Oil | 0.56 | 15.5% | 0.75871 | 0.759 |

-continued

| | $K_1$ | $K_2$ | $K_3$ | $K_3$ (rounded) |
|---|---|---|---|---|
| Natural Gas | 0.38 | 11.8% | 0.67627 | 0.676 |

The above corrections of the A/D converter readings of the thermocouple and oxygen sensor outputs are applied automatically within the microprocessor 10. In the case of the thermocouple reading this simply comprises multiplying the A/D converter reading by a constant factor of 4.835, while in the case of the oxygen sensor, an initial calibration measurement (S') is carried out on ambient air to determine the value of the calibration constant k in accordance with equation (IV) ($k = 4.2651 \times S'$) and then this value of the constant is used to calculate the oxygen concentration of the flue gases from a subsequent measurement S using equation (III) as explained above. Using these values the stack loss is then calculated in accordance with equation (VII), or the efficiency derived from the stack loss, selecting an appropriate value for the constant $K_3$ dependent upon the type of fuel, the three different K values being stored within the ROM 42 of the microprocessor 10.

The calibration and measurement procedure of the fuel efficiency monitor will now be described. The main programme is illustrated by the flow diagram in FIG. 4, consisting of a 'calibration' routine, an 'operation' routine and a stack loss (efficiency) calculation. In addition, there is an interrupt programme illustrated by the flow chart in FIG. 5 which runs continually with a cycle time of 2 ms, serving to update the display, keep track of time and to change the contents of the display to a required value e.g. $O_2$ concentration or stack loss value, whenever the display select switch 19 is operated.

Referring first to FIG. 4, when the monitor is switched on the alpha-numeric display 25 and the indicator lights 27, 28 remain off. The operator then puts the probe containing the thermocouple 'hot' junction 5 and the oxygen sensor 3 into the ambient atmosphere and operates the calibrate switch 17. This initiates the "calibrate" routine at the main programme outlined in broken lines, which switches on the pump motor 22, waits for 5 seconds and reads the conversion result on channel A/D 1 of the A/D converter 45. If this converter reading lies between 220 and 250, corresponding to a 20 to 22% oxygen concentration, the motor 22 is switched off. If not further readings are taken until a reading of between 220 and 250 is obtained whereupon the motor 22 is switched off.

This reading (S') is then taken as corresponding to the nominal ambient $O_2$ concentration of 20.9% and used to calculate the calibration constant k in accordance with equation (IV) i.e. by multiplying it by 4.265. The calibration constant thus calculated is then temporarily stored in the RAM 43 and the calibration indicator light 27 switched ON. This indicates to the operator that the calibration of the $O_2$ sensor has been completed, that the sensor probe should be inserted into the flue, and that the "operate" switch 18 should be actuated. This initiates the 'operate' routine of the programme which starts with a 15 second wait after which the conversion result appearing on channel A/D 2 of the converter 45 is read. A second reading of converter channel A/D 2 is taken 5 seconds later and compared with the first. If the two values differ by 2 or less, corresponding to a temperature difference of about 10° C. or less, this temperature value is recorded and the pump motor 22 is switched on in preparation for the oxygen concentration measurement of the flue gases. If not, the process is repeated every 5 seconds until the difference between two successive readings is less than or equal to 2.

After the sensor probe pump motor 22 has been switched on there is a delay of 5 seconds and the reading (S) on A/D 1 is taken. The "reading taken" indicator light 28 is then switched on, and following a further delay of 10 seconds an audible warning is sounded by actuation of the oscillator 20 which powers the speaker 21 to indicate that the probe can be withdrawn from the flue. The pump motor 22 is then switched off.

The values read from the two channels of the A/D converter during the above-described section of the programme merely provide a digital representation of the value of the output signal from the respective sensors 3, 5. As described earlier, these values require a correction to convert them to actual oxygen concentration and temperature values. In order to do this the uncorrected oxygen concentration value from channel A/D 1 of the A/D converter 45 is divided by the oxygen sensor calibration constant k determined earlier, to derive a value $\chi = S/k$ (where S is the A/D conversion result of the flue oxygen concentration as in equation (I), (II) and (III)). This is then used in equation (III) to calculate the corrected oxygen concentration value C as follows:

$$C = \chi(1 - \chi/2) \text{ where } \chi = S/k$$

This value of C is thus the actual fractional oxygen concentration of the flue gases, and is temporarily stored while the uncorrected temperature value from channel A/D 2 of the converter 45 is corrected by multiplying it by a fixed correction factor of 4.835 to give a digital value equal to the difference in temperature between the flue gases and the ambient temperature. After a delay of 10 seconds the audible warning produced by the speaker 21 is switched off, indicating that the fuel select switch 16 should be set to the appropriate fuel to initiate calculation of the efficiency or stack loss value. This determines which of the three different values for the constant $K_3$ (it is 0.738 for solid fuel; 0.759 for fuel oil; 0.676 for natural gas) should be used with the corrected temperature value $(T_1 - T_2)$ and the corrected $O_2$ concentration (C) in the calculation of equation (VII). The warning light 27 is then switched on and the reading taken light 28 switched off. Further flue gas readings can then be taken e.g. from different sections of the flue by repeated operation of the 'operate' switch 18.

Once the corrected temperature, oxygen concentration and stack loss values have been determined, these values are stored in respective buffers B1,B2 and B3 (not shown) and are made available for display on the three seve-segment alpha-numeric displays 25*a*, 25*b*, 25*c* of the display module 24. This facility is provided by the 'interrupt' programme, the flow diagram of which is illustrated in FIG. 5, which is controlled by the "display select" switch 19.

This routine is cyclically repeated at regular intervals, 2 ms in the present example, and at the beginning of each cycle an internal 8-bit counter is incremented by a count of 1. A complete cycle of the counter thus takes $256 \times 2$ ms $= 0.512$ seconds, and this is used as a clock to control the timing of the various delays which occur in the operation of the main programme.

The apparatus described so far is adapted to automatically compute the heat loss or stack loss of the exhaust gases of the heating appliance. However, as discussed earlier it may readily be modified to alternatively or additionally display an indication of the percentage operating efficiency ($\eta$) of the heating appliance from the derived measurement values of $\%O_2$ and $(T_1 - T_2)$ already described.

Calculation of $\eta$ based on the gross calorific value of the fuel may be achieved by programming the microprocessor 10 to perform the following calculation:

$$\eta = 100 - \left[ R + K_3 \frac{(T_1 - T_2)}{21 - \%\,O_2} + K_4\{P + (T_1 - T_2)\} \right] \quad \text{(VIII)}$$

where R is a constant related to the radiation losses of the heating appliance (typically between 3% and 10%) $K_4$ is a constant related to the type of fuel used, P is a constant related to the hydrogen and moisture content of the air applied to the appliance (in this example nominally set at 1121.4) and $K_3$, $T_1$ and $T_2$ are as previously defined.

The second term in the square brackets will be recognised as the stack loss from equation (VIII) which value may simply be substituted into the equation, if previously calculated. Again, different values for the constant $K_4$ in addition to those for $K_3$ may be stored and selected upon operation of the fuel select switch 16, together with a range of values for P which may be selected according to the type of heating appliance. Typical values for $K_4$ are as follows:

| | |
|---|---|
| Solid fuel | 0.00409 |
| Fuel Oil | 0.00512 |
| Natural Gas | 0.00828 |

Where it is required to measure the stack loss on the basis of the $\%CO_2$ concentration of the exhaust gases, using a $CO_2$ sensor in place of the $O_2$ sensor described, equation (V) may be used instead of equation (VII). Different values of the constant $K_1$ as previously listed for different types of fuel may then be stored and selected by operation of the fuel select switch 16. Of course, the calibration and linearisation procedure requires modification to take account of the different relationship in the variation of the $CO_2$ sensor output signal with the measured quantity, but similar principles to those described above for calibration of the $O_2$ sensor may be employed.

Once the stack loss has been calculated, this value may be substituted as the second term in the square brackets of equation (VIII) above to determine the percentage efficiency ($\eta$).

In addition to this, the interrupt programme monitors the input line of port 12 to which the display select switch 19 is connected to determine whether it has been operated since the preceding cycle, and if it has it replaces the information on the display with information drawn from a different one of the three buffers, B0, B1, B2 selected by different values of $\chi = 0, 1$ or 2. For example, if the display is showing the temperature value contained in buffer B0, then operation of the display select switch 19 will change $\chi = 0$ to $\chi = 1$ causing this displayed information to be replaced by that from buffer B1, i.e. the corrected oxygen concentration value. If the display select switch is pressed again, $\chi$ changes from $\chi=1$ to $\chi=2$ the display 25 will be refreshed with information drawn from buffer B2, i.e. the stack loss value. Further operation of the display select switch will change from $\chi=2$ to $\chi=0$, returning the original temperature value from buffer B0.

Simultaneously, with the displayed information a respective one of the three indicator lights 26*a*, 26*b*, 26*c* will light up to indicate which piece of information is currently on display.

The purpose of comparing successive readings of the temperature sensor output signals appearing on channel A/D 2 of the A/D converter 45 at 5-second intervals, until successive readings differ by less than a predetermined amount, is to ensure that the temperature of the temperature sensor has risen and settled to the actual temperature of the flue gases.

It will be appreciated that apparatus specifically described is only a preferred embodiment, and many modifications may be made to it without departing from the scope of the present invention. For example, different forms of temperature and oxygen or $CO_2$ sensor may be used, requiring modification, inter alia to the methods used in their calibration and linearisation of their output signals. Both sensors may have non-linear response, requiring a non-linear correction also to be applied to the temperature sensor output signal. Further, the invention is not restricted to the particular form of microprocessor used, other forms of microprocessor may equally be used, whether or not they incorporate built-in A/D conversion means. External A/D conversion means may readily be employed where necessary. The range of fuels for which the apparatus is intended may be varied as appropriate or extended to include other forms of fuel by appropriate selection of the constant $K_3$ and $K_4$ in equations (VII) and (VIII).

We claim:

1. Apparatus for measuring the degree of efficiency of a combustion appliance, comprising a first sensor for producing an output signal which varies with the concentration of a constituent gas of the exhaust gases of the appliance, a second sensor for producing an output signal which varies with the temperature of the exhaust gases, and computation means adapted to receive the sensor output signals and operable on instruction for deriving therefrom measurement values representing the concentration of said constituent gas and the temperature of the exhaust gases and for applying said measurement values in the computation of a predetermined formula relating the degree of combustion efficiency to the temperature of the exhaust gases and the concentration of said constituent gas and producing an output signal indicative of the combustion efficiency of the appliance, the computation means is operable to derive a said measurement value from at least one of the sensor output signals in accordance with a formula defining the relationship between variations of the sensor output signal with the measured quantity; and that the computation means is also operable in response to a calibrate instruction to derive from the output signal produced by that sensor during a test measurement of a known value, a coefficient of the said formula defining the relationship between variations in the sensor output signal with the measured quantity and the measured quantity, and for automatically calibrating the sensor output signal by applying the coefficient in said formula during a subsequent measurement or measurements taken with the sensor.

2. Apparatus as claimed in claim 1, wherein the computation means is operable to calibrate the first sensor signal from a test measurement of a test gas having a known concentration of said constituent gas.

3. Apparatus as claimed in claim 1, wherein the following relationship defines the variation between the output signal of the first sensor and the measured quantity:

$$\text{Fractional concentration} = 1 - \exp - S/k$$

where S is the output signal value of the first sensor and k is said coefficient.

4. Apparatus as claimed in claim 3, wherein the computation means is operable to compute a value for the coefficient k in accordance with the following formula:

$$k = \frac{S'}{\log_e \frac{1}{1 - C'}}$$

where S′ represents the value of the output signal produced by the first sensor from the test measurement and C′ represents the fractional constituent gas concentration of the test gas.

5. Apparatus as claimed in claim 4, wherein the computation means is adapted to calibrate the first sensor signal from a test measurement of ambient air, the value of C′ being set to correspond to the nominal concentration of said constituent gas in ambient air.

6. Apparatus as claimed in claim 3, wherein the computation means is operable to derive a measurement value of the constituent gas concentration in accordance with the following formula:

$$\text{Fractional Constituent gas concentration} = S/k.(1 - S/2k)$$

where S represents the output signal of the first sensor produced by measurement of the exhaust gases.

7. Apparatus for measuring the degree of efficiency of a combustion appliance comprising a first sensor for producing an output signal which varies with the concentration of a constituent gas of the exhaust gases of the appliance, a second sensor for producing an output signal which varies with the temperature of the exhaust gases, and computation means adapted to receive the sensor output signals and operable on instruction for deriving therefrom measurement values representing the concentration of said constituent gas and the temperature of the exhaust gases and for applying these measurement values in the computation of a predetermined formula relating the degree of combustion efficiency to the temperature of the exhaust gases, and the concentration of said constituent gas for providing an output signal indicative of the combustion efficiency of the appliance; the computation means is also operable to calibrate at least one of the sensor output signal from a test measurement made with that sensor, and wherein the computation means is operable in response to a calibrate instruction for deriving from the output signal produced by at least one of the sensors during a test measurement of a known value, calibration information regarding that sensor, and for automatically calibrating the sensor output signal applying said calibration information to introduce a calibration correction when deriving measurement values from the sensor output signal produced during a subsequent measurement or measurements taken with the sensor; the computation means in carrying out a said test measurement of the said constituent gas concentration of ambient air or other test gas, automatically sampling the value of the output signal of the first sensor, comparing its value with that of a stored value representing the estimated value of the sensor output signal for the nominal or known concentration of said constituent gas in the test gas, and if the difference between the compared values is above a predetermined limit, repeating the comparison after a predetermined interval, until the difference between the compared values falls within the limit.

8. Apparatus as claimed in claim 7, wherein the computation means is operable, in deriving a measurement value from the temperature sensor output signal, automatically to sample the value of the temperature sensor output signal to store the sampled value for a predetermined period and then to re-sample the value of the temperature sensor output signal, to compare the two sampled values, and to repeat the procedure until the difference between two successive sampled values is below a predetermined limit whereupon to retain one of these two values as the said measurement value.

9. Apparatus as claimed in claim 8, including means for visually and/or audibly indicating when a test measurement of the constituent gas concentration has been obtained.

10. Apparatus as claimed in claim 8, wherein the first sensor is an electrochemical oxygen sensor.

11. Apparatus as claimed in claim 8, wherein the temperature sensor is arranged to produce an output signal which varies with the difference between the exhaust gas temperature and a reference temperature.

12. Apparatus as claimed in claim 11 wherein the temperature sensor is a type K alloy thermocouple having a substantially linear variation in its output signal with the measured quantity over the range of interest.

13. Apparatus as claimed in claim 8, including means for visually and/or audibly indicating when measurement values of the temperature and constituent gas concentration of the exhaust gases have been derived.

14. Apparatus as claimed in claim 8 wherein the computation means is operable to calibrate the temperature sensor signal from a test measurement of said reference temperature.

15. Apparatus as claimed in claim 8, wherein the measure of the degree of combustion efficiency is provided by an indication of the heat loss or stack loss of the heating appliance.

16. Apparatus as claimed in claim 8, wherein the first sensor is an oxygen sensor, and the predetermined formula for computing the heat loss or stack loss is:

$$\text{Heat loss} = \frac{K_3 (T_1 - T_2)}{\%\ O_{2IN} - \%\ O_{2OUT}}$$

where $K_3$ is constant related to the fuel used by the heating appliance, $T_1$ and $T_2$ are the exhaust gas temperature and a reference temperature respectively, and $\%O_2IN$ and $\%O_2OUT$ are the percentage $O_2$ concentration of the combustion air supplied and the exhaust gases respectively.

17. Apparatus as claimed in claim 16, wherein different values of the constants $K_3$ and/or $K_4$ are stored in the computation means for different types of fuels, and the apparatus includes means for selecting said different values for use in the computation of the predetermined formula.

18. Apparatus as claimed in claim 8, wherein the measure of the degree of combustion efficiency is provided by an indication of the operating efficiency ($\eta$).

19. Apparatus as claimed in claim 18, wherein the first sensor is an oxygen sensor and the predetermined formula for computing the operating efficiency:

$$\eta = 100 - \left[R + \frac{K_3 (T_1 - T_2)}{\%\ O_{2IN} - \%\ O_{2OUT}} + K_4\{P + (T_1 - T_2)\}\right]$$

where R is a constant related to the type of heating appliance, $K_3$ and $K_4$ are constants related to the type of fuel used, P is a constant related to the moisture and hydrogen content of the combustion gases supplied to the heating appliance, $T_1$ and $T_2$ are the temperature of the flue gases and a reference temperature respectively, and $\%O_2IN$ and $\%O_2OUT$ are the percentage $O_2$ concentrations of the combustion air supplied and of the exhaust gases respectively.

20. Apparatus as claimed in claim 8, including display means for displaying measurement values derived by the computation means for the constituent gas concentration and temperature of the exhaust gases, and the result of the computation of said predetermined formula using these measurement values.

21. Apparatus for measuring the degree of efficiency of a combustion appliance, comprising a first sensor for producing an output signal which varies with the concentration of a constituent gas of the exhaust gases of the appliance, a second sensor for producing an output signal which varies with the temperature of the exhaust gases, and computation means adapted to receive the sensor output signals and operable on instruction for deriving therefrom measurement values representing the concentration of said constituent gas and the temperature of the exhaust gases and for applying said measurement values in the computation of a predetermined formula relating the degree of combustion efficiency to the temperature of the exhaust gases and the concentration of said constituent gas and for producing an output signal indicative of the combustion efficiency of the appliance, the computation means also being operable in response to a calibrate instruction for deriving from the output signal produced by at least one of the sensors during a test measurement of a known value, calibration information regarding that sensor, and for automatically calibrating the sensor output signal by applying said calibration information to introduce a calibration correction during a subsequent measurement and further measurements taken with the sensor.

22. Apparatus for measuring the degree of efficiency of a combustion appliance comprising a first sensor for producing an output signal which varies with the concentration of a constituent gas of the exhaust gases of the appliance, a second sensor for producing an output signal which varies with the temperature of the exhaust gases, and computation means adapted to receive the sensor output signals to derive therefrom measurement values representing the concentration of said constituent gas and the temperature of the exhaust gases and for applying said measurement values in the computation of a predetermined formula relating the degree of combustion efficiency to the temperature of the exhaust gases and the concentration of said constituent gas and for producing an output signal indicative of the combustion efficiency of the appliance, the computation means is also operable in response to a calibrate instruction for deriving from the output signal produced by at least one of the sensors during a test measurement of a known value, calibration information regarding that sensor, and for automatically calibrating the sensor output signal by applying said calibration information for introducing a calibration correction when deriving measurement values from the sensor output signal produced during a subsequent measurement or measurements taken with the sensor; the computation means in deriving a measurement value from the temperature sensor output signal, automatically sampling the value of the temperature sensor output signal, storing the sampled value for a predetermined period, resampling the value of the temperature sensor output signal, comparing the two sampled values, repeating the procedure until the difference between two successive sampled values is below a predetermined limit and then retaining one of these two values as the said measurement value.

23. Apparatus for measuring the degree of efficiency of a combustion appliance comprising a first sensor for producing an output signal the value of which varies with the concentration of a constituent gas of the exhaust gases of the appliance, a second sensor for producing an output signal the value of which varies with the temperature of the exhaust gases, at least one of said output signals varying non-linearly with the measured quantity, and the computation means adapted to receive the sensor output signals, and to correct any such non-linearity by applying a correction derived from the known relationship between the sensor output signal and the measured quantity for producing respective measurement values which vary substantially linearly with different values of the measured quantities and for applying said measurement in the computation of a predetermined formula relating the degree of combustion efficiency to the temperature of the exhaust gases, and of the concentration of said constituent gas for producing an output signal indicative of the combustion efficiency of the appliance, and the computation means is also operable in response to a calibrate instruction for deriving from the output signal produced by at least one of the sensors during a test measurement of a known value, calibration information regarding that sensor, and for automatically calibrating the sensor output signal by applying said calibration information for introducing a calibration correction when deriving measurement values from the sensor output signal produced during a seubsequent measurement or measurements taken with the sensor.

* * * * *